United States Patent [19]

Stubbmann

[11] 3,983,647

[45] Oct. 5, 1976

[54] DRIVEN MOBILE

[75] Inventor: Albert Stubbmann, Franklin Lakes, N.J.

[73] Assignee: Kohner, Inc., New York, N.Y.

[22] Filed: Feb. 4, 1974

[21] Appl. No.: 438,971

Related U.S. Application Data

[60] Continuation of Ser. No. 266,908, June 28, 1972, abandoned, which is a division of Ser. No. 122,471, March 9, 1971, Pat. No. 3,698,252.

[52] U.S. Cl. ..... 40/28.1; 84/94 C; 84/102

[51] Int. Cl.[2] ..... G09F 27/00

[58] Field of Search ..... 40/28.1, 28 R, 28.2, 40/33, 28.3, 32, 128; 46/52, 32, 47, 63, 66, 114, 232, 236; 84/94, 94 C, 102

[56] References Cited

UNITED STATES PATENTS

| | | | |
|---|---|---|---|
| 1,275,791 | 8/1918 | Thereault | 40/71 |
| 1,314,189 | 8/1919 | Goolman | 84/102 |
| 1,816,647 | 7/1931 | Goriup | 84/102 |
| 2,752,877 | 7/1956 | Starkenberg | 84/94 C |
| 3,048,083 | 8/1962 | Rosenbaum | 40/28.1 |
| 3,078,593 | 2/1963 | Miller | 40/28.1 |

FOREIGN PATENTS OR APPLICATIONS

| | | | |
|---|---|---|---|
| 562,834 | 3/1958 | Belgium | 84/94 |

*Primary Examiner*—Edgar S. Burr
*Assistant Examiner*—A. Heinz
*Attorney, Agent, or Firm*—Seidel, Gonda & Goldhammer

[57] ABSTRACT

A driven mobile having a plug secured to a shaft with a plurality of arms radially extending from the plug. Objects of interest are secured to each arm and the shaft is rotated by a magnetic escapement mechanism. The mobile further includes an audio signal generating device which operates in conjunction with the rotation of the shaft.

2 Claims, 16 Drawing Figures

FIG. 1
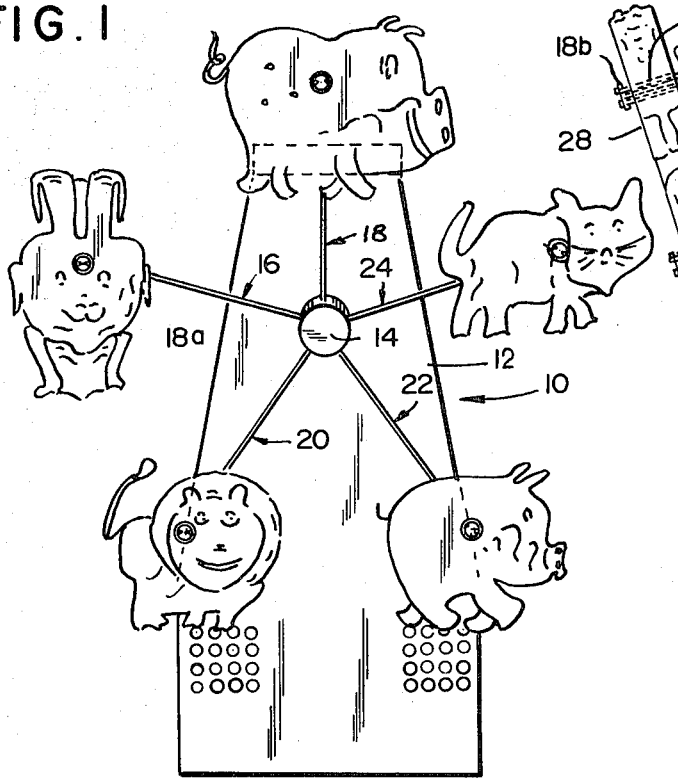
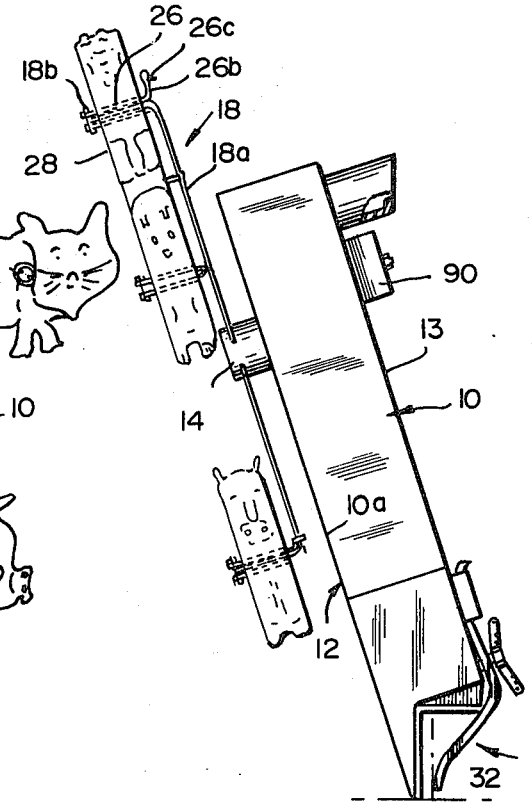
FIG. 2
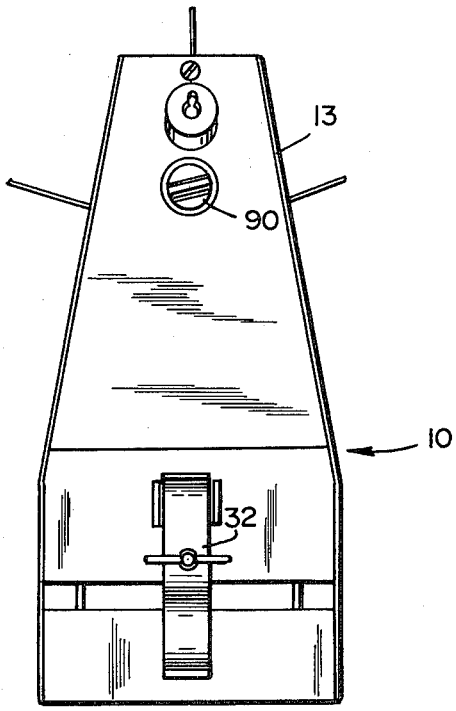
FIG. 3

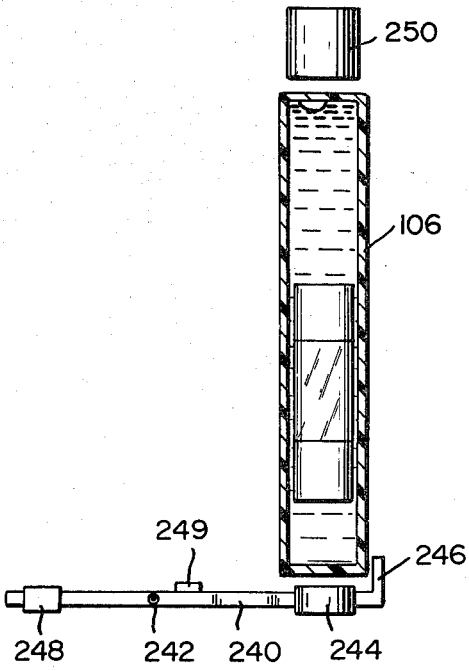
FIG. 10
FIG. 11
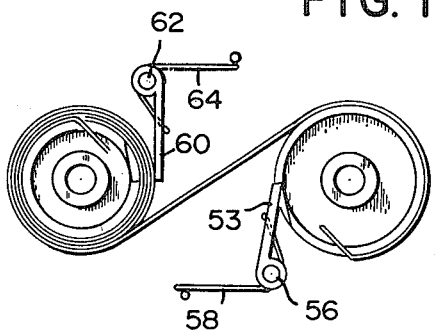
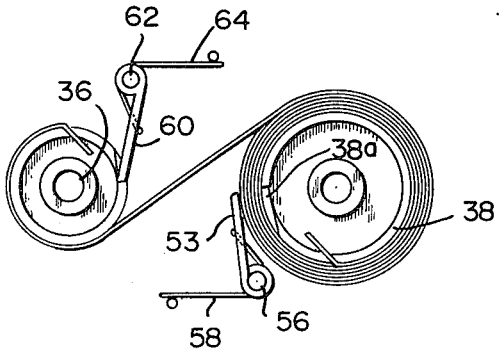
FIG. 12
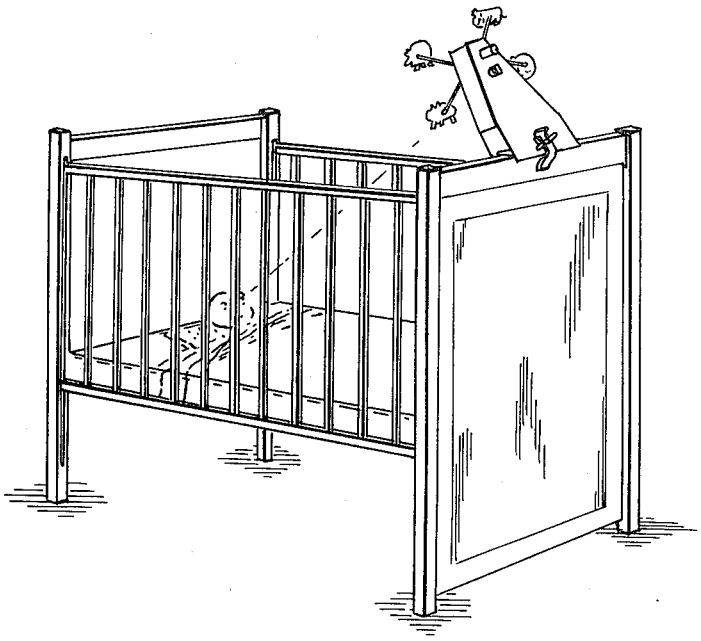
FIG. 13

DRIVEN MOBILE

This is a continuation, of application Ser. No. 266,908, filed June 28, 1972, now abandoned, said latter application being a division of Ser. No. 122,471, filed Mar. 9, 1971, now U.S. Pat. No. 3,698,252.

BACKGROUND OF THE INVENTION

1. Field of the Invention

Mobile having novel drive means.

2. Description of the Prior Art

Driven mobiles have been known and used for many years for entertaining babies and young children. As an example, one type of prior art mobile included a plurality of attention getting objects which were suspended from a canopy. The canopy was secured to a side of a crib by clamping means so as to be generally horizontal and a driving means was provided for continually rotating the canopy and the objects suspended therefrom. Usually the objects were shaped to simulate different animals such as elephants, tigers, etc. However, quite frequently the continued rotation of the objects of interest about an axis of rotation did not maintain the babies or young child's interest for longer than a few minutes as the continued rotation rapidly became monotonous. Other types of mobiles were of course known as will be apparant to those knowledgeable in the art.

Many prior art driven mobiles included a spring wound motor for supplying the driving force for the mobile. Typically, many of these motors included a winding key which upon being rotated supplied energy to a spring that in turn drove the mobile. However, with most prior art driven mobiles the mobile was driven continuously by the motor for only a very short period of time, e.g. a few minutes, after which rewinding of the key was required to continue operation of the mobile. This was undesireable since one of the objects of a mobile is to maintain the child's interest for a long period of time without the need for adult attention and the few minutes most prior art mobiles were able to run continuously for made the mobile unsuitable for this intended purpose.

Still another disadvantage of many prior art driven mobiles of the type hereinabove described was that once the mobile had been attached to a crib or some other similar item of baby furniture at a particular location thereon it was difficult to vary the orientation of the mobile at the location in an attempt to obtain the orientation which would maximize the interest of a baby or young child in the mobile.

Some prior art mobiles had sound producing means which often was a music box that was separate from the mobile. Usually the music box had its own driven means which generally comprised a spring motor that was wound and which, like the mobile, ran for a few minutes during which time music was provided and then stopped running. As with the mobile itself, the limited amount of time which the music box could be played for continuously upon a single winding detracted from its ability to assist in entertaining a baby or yound child.

Many of the prior art mobiles that had a spring motor as the driving means included some sort of governor to regulate the speed of the mobile. However, the governor in no way protracted the running of the mobile after the spring motor therefor had been wound.

It is readily apparent that if a driven mobile could be provided which upon receiving a given input of energy would operate for a substantial period of time it would find widespread popularity. Additionally, if audio means such as a music box, chime, bell etc. could intermittently play for the duration of the mobile running time this would further enhance the value of the mobile.

SUMMARY OF THE INVENTION

It is therefore an object of the present invention to provide an improved driven mobile.

More specifically, it is an object of the present invention to provide an improved driven mobile which can be run for a substantial continuous period of time without the need for any attention.

A still further object of the present invention is to provide an improved driven mobile having a plurality of attention getting objects which are rotated about a common axis of rotation with each object having an axis about which it can be oscillated.

A still further object of the present invention is to provide a driven mobile having at least one attention getting object and a music box with there being means for rotating in increments the object about an axis periodically throughout a substantial period of time and for playing the music box intermittently during the substantial period of time.

Still another object of the present invention is to provide a driven mobile which can be driven for discrete periods of time throughout a substantial continuous total period of time and intermittently produce a pleasing audio signal throughout said total period of time.

A still further object of the present invention is to provide a driven mobile of the type herein described wherein the mobile can be secured in a number of positions on an object such as a crib, etc., and placed in a plurality of different orientations at each position so that an orientation can be selected at each position which will maximize the interest of an infant or yound child in the mobile.

A still further object of the present invention is to provide an escapement mechanism for a mobile wherein the escapement mechanism insures that drive means for the mobile will drive the mobile periodically during a substantial continuous period of time for each input of energy to the drive means.

Another object of the present invention is to provide an improved general utility escapement mechanism.

Still another object of the present invention is to provide an escapement mechanism which can be used in a driven mobile as hereinabove set forth and which also has general utility.

Briefly, in accordance with the present invention, the foregoing and other objects are achieved by a driven mobile having a plurality of arms which are fixed relative to a first shaft and rotatable therewith. The free ends of each of said arms are bent perpendicularly to the rest of said arms and an object of interest is secured to the bent end of each of said arms. The object of interest can be a simulated elephant, a simulated tiger, a simulated horse, etc. Means is provided for allowing each object of interest to oscillate about the bent portion of the arm to which it is secured as the arm is rotated with the shaft.

A drive means is provided for periodically rotating the shaft and includes a spring driven motor. The spring driven motor rotates a second shaft which is secured to a portion of the mobile housing. A first pair of step up engaged gears are secured to the first and second shafts to rotate the shafts together with the first shaft, as a result of the step up gears rotating faster than the second shaft. A second pair of step up engaged gears is provided and one gear thereof is rotatable with a third shaft and the other with the first shaft, with the third shaft, as a result of the step up gears, rotating faster than the first shaft. An escapement mechanism controls the rotation of said third shaft and hence that of said first and second shafts.

The escapement mechanism includes a tube which is closed at opposed ends and fixed to said third shaft. Located in said tube are a pair of magnets which are separated from each other by a non-magnetic spacer. The magnets are arranged so that identical poles such as the south poles are positioned adjacent the spacer with the north poles of said magnets being diametrically opposed to each other. Preferably, the magnets and the spacer are all of the same cross-section which is slightly smaller than the cross-section of the inside of the tube. A low viscosity fluid such as water or mineral oil is located in the tube for a purpose that will soon be apparent.

Secured to the mobile housing in a position that is adjacent the bottom of the tube when the tube is in a vertical position is a lever which is rotatable about a horizontal axis to a vertical position. The lever includes a stop and when the lever is vertical the stop is in the path of rotation of the tube to prevent any rotation thereof. The lever at its uppermost portion includes a magnet having two faces with the face of the magnet closest to the tube being the north pole and the other face of said magnet being the south pole. Attached to the mobile housing is a further magnet which is in registry with the magnet located on the lever when the lever is vertically and has its south pole facing and adjacent the south pole of the magnet located on the lever.

As a result of the above arrangement the lever is biased to pivot about its rotational axis so that its magnet moves as far away from the magnet on said housing and means is provided for limiting the rotation of the lever to a vertical position.

In operation, when the spring motor is wound there will be a torque applied to the second shaft which will tend to rotate the gear secured thereto. This in turn will apply a driving force to the gear on the first shaft which is in engagement with the gear on the second shaft. However one of the gears on the first shaft is in engagement with a gear on the third shaft. The third shaft cannot rotate unless the tube which is rotatable therewith is free to rotate. Assuming that the tube is in a vertical position with the spaced-apart magnets therein near the then top of the tube it can be seen that the tube and hence the third shaft and other shafts will not be able to rotate. This is because the magnet on the lever will be urged away from the magnet on the housing so that the lever will be in a vertical position and the stop thereon will prevent the tube from rotating. The spaced-apart magnets within the tube will slowly descend to the bottom of said tube under the force of gravity with some of the fluid within the tube moving along the sides of the magnets and the spacer upwardly during this downward descent. The fluid within the tube controls the rate of descent of the magnets and a dash pot effect is created.

When the downward descent is finished the north pole of the bottommost magnet in the tube will be in contact with the bottom of the tube and will repel the north pole of the magnet on the lever and the lever will pivot in a direction away from the tube so that the stop is no longer preventing the tube from rotating. It is to be appreciated that the moment on the lever from the magnetic repulsion between the south poles of the magnets on the lever and on the housing and the frictional force between the stop and tube is less than the moment on the lever from the repulsion between the north pole of the magnet carried by the lever and the north pole of the magnet in the tube that is at the then bottom of the tube and which urges the lever away from the vertical position. Consequently, as a result of the above described arrangement of parts, the lever no longer is positioned so that its stop halts rotation of the tube and the tube is free to rotate. The three shafts can now rotate under the influence of the spring motor. This results in the arms which are secured relative to said first shaft rotating. Each of the objects of interest in turn oscillates about the end of the arm to which it is attached with, as mentioned above, means being attached to each object to prevent said object from making a complete rotation about the end of the arm but merely oscillating about said end. As soon as the tube is rotated a few degrees as a result of the rotation of said shafts, the magnet which was at the bottom of the tube previously will no longer be positioned adjacent the lever and the repulsion between the magnet on the housing and the magnet on the lever will move the lever to the vertical position so that its stop will prevent the tube from rotating further when the tube again comes to a vertical position after it has rotated 180 degrees. At this time, rotation of the three shafts will be stopped and the cycle again repeated.

If desired, means can be provided for intermittently sounding a chime while the mobile is operating. This can be done by having pins rotate in conjunction with the second shaft. Preferably four pins are utilized, attached to the motor and are symmetrically positioned about the axis of rotation of the second shaft. Guide pins are secured to the mobile housing and a frame member having internal slots is positioned with the guide pins extending through said slots. Means is provided for elevating and lowering the frame member for ninety degrees of rotation of the second shaft. Attached to the frame member is a chime striker and positioned beneath said chime striker and secured to said housing is a chime bar. Each time the frame member is elevated and lowered, the chime striker hits the chime bar to produce a sound.

In an alternate embodiment of the present invention a music box is secured to the mobile housing. The music box has a lever which when elevated allows said music box to play and which when horizontal or in its normal position prevents the music box from being played. Means is provided for elevating and lowering a frame member for ninety degrees of rotation of the second shaft and the music box lever is actuated by the frame. Thus, when the frame is lifted the music box plays and when the frame is in its lower position the music box does not play.

These and various other objects and advantages of this invention will become apparent to the reader in the following description.

This invention accordingly consists in the features of construction, combinations of elements and arrangements of parts which will be exemplified in the device hereinafter described and of which the scope of application will be indicated in the appended claims.

BRIEF DESCRIPTION OF THE DRAWINGS

In the drawings:

FIG. 1 is a front plan view of an embodiment of the present invention;

FIG. 2 is a side view of the structure shown in FIG. 1;

FIG. 3 is a rear view of the structure shown in FIG. 1;

FIG. 10 is a sectional view of an alternate embodiment of the present invention;

FIGS. 11 and 12 are front plan views showing the means for preventing each sheave for the spring motor from being rotated when nearly all the strip of spring material has been placed on other sheave;

FIG. 13 is a perspective view showing how the embodiment of the present invention can be utilized on a child's crib;

DESCRIPTION OF THE PREFERRED EMBODIMENTS

Figures 4, 5, 6:
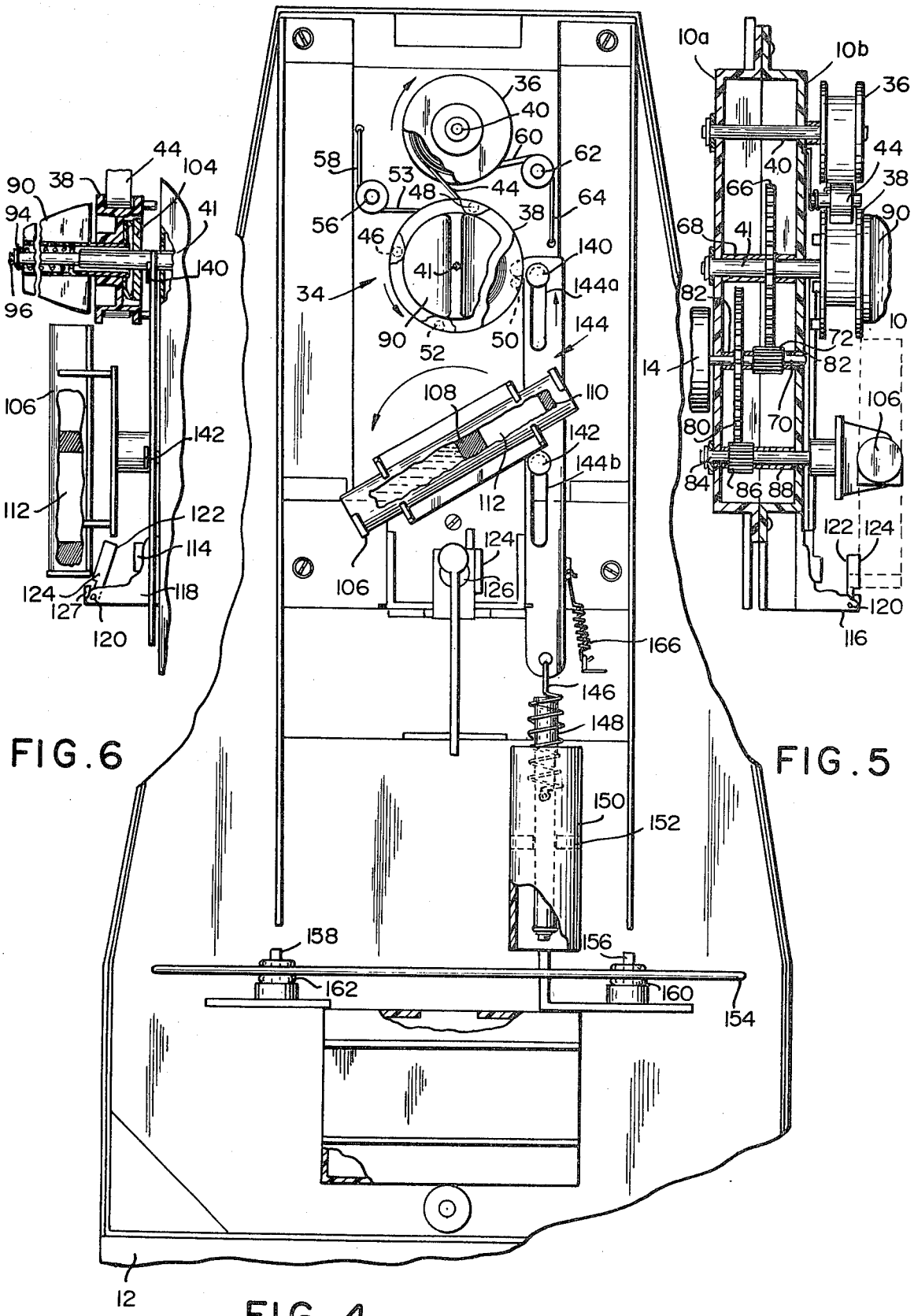
FIG. 4 is a partially broken rear plan view showing the escapement mechanism and chime structure of the present invention.
FIG. 5 is a partially broken left view of the escapement mechanism and spring motor drive.
FIG. 6 is a right side partially broken right view of a portion of the escapement structure.

In FIGS. 1–3 of the drawings an embodiment of the present invention is illustrated and includes a housing 10 having a front wall 10*a* and a panel on wall 10*a* which while being shown as having a particular shape could obviously be of any configuration. Secured to rear wall 10*b* of housing 10 is cover 13 with the cover only shown in FIGS. 1 through 3 and FIG. 16 so that the details of the present invention are readily apparent. A hub 14 is secured for rotation relative to panel 12 as will hereinafter be described and arms 16, 18, 20, 22 and 24 are radially secured to hub 14 symmetrically about the periphery of said hub. The hub may be made of plastic or any other material as will be apparent to those skilled in the art while the arms may be made of any ferrous material or for that matter of any other material which has good rigidity and a long service life. Arms 16, 18, 20, 22 and 24 are identical to each other and accordingly a description of one arm will suffice for an understanding of the present invention.

Arm 18 is L-shaped and includes a longer leg 18*a* and a shorter leg 18*b* which extends perpendicularly from the free end of leg 18*a* in a direction so as to be pointed away from panel 12 and perpendicular thereto. Rotatable about leg 18*b* is a cylindrical bearing member 26 which is selected to be of a size so that it is freely rotatable about leg 18*b* and means is provided for preventing said member from sliding axially along the leg and off the free end thereof. These means can be conventional as will be apparent to those skilled in the art.

Secured to the rear of bearing member 26 is an arm 26*b* which is perpendicular to the bearing member. A locking link 26*c* extends from the end of arm 26*b* which is not attached to bearing member 26, is perpendicular to arm 26*b* and extends rearwardly away therefrom for a reason which will soon be apparent. Secured to and rotatable with bearing member 26 is an object of interest 28 which could be a simulation of an animal, of a person, etc. It is to be appreciated while certain objects of interest are shown in the drawings and while five arms are shown to which said objects are attached that any number of arms could be utilized and any different objects of interest could be attached to said arms. The means of securing the object of interest to the bearing member includes passing the bearing member through the object of interest at a point in the object spaced from its center of gravity.

As can be seen in FIG. 2 clamping means 32 is attached to the rear of housing 10 at the bottom thereof for attaching the housing to a crib footboard (see FIG. 13) or some other furniture item. The clamping structure is shown and designed so as to be able to clamp the mobile to a piece of furniture at a given location and at different orientations at the location. The clamping means may be conventional as will be apparent to those skilled in the art. Preferably the clamping means is arranged in a manner such that the axis of rotation of the hub tilts downward at a slight angle, e.g. 30° to the vertical, whereby the toy squarely faces an infant lying in the crib.

As can be seen in the figures a spring motor 34 is provided for rotating the mobile of the present invention. Spring motor 34 can be conventional and preferably is a constant torque motor such as the HUNTER NEGATOR produced by Hunter Spring of Hatfield, Pennsylvania which is described herein. Of course, other types could be used if desired. Spring motor 34 includes an upper sheave 36 and a lower sheave 38 with both sheaves adjacent wall 10*b* and outside housing 10. Sheave 36 is rotatable about a shaft 40 which is suitably journalled between opposite side walls 10*a* and 10*b* of housing 10. Sheave 38 is rotatable counter-clockwise (as viewed in FIG. 4) with a shaft 41 which is suitably journalled between the opposed walls of housing 10. The manner of rotating sheave 38 in a clockwise direction about the shaft 41 will hereinafter be described. A thin strip of material 44, such as a strip of steel, is stressed to the form of a tight spiral coil with its ends secured in reverse curvature to sheaves 36 and 38. Rotatable with sheave 38 are pins 46, 48, 50 and 52 at ninety degree increments about the periphery of the sheave on the back thereof. The pins all have one-way cammed ends for a reason soon to be apparent. Sheave 38 includes a notch 38*a* in its base and a pawl 53 is pivotable about an axis defined by a pin 56 which is secured to housing 10. The pawl is biased toward the sheave by a hair pin spring 58. The notch and pawl are arranged so that when the pawl contacts the base of the sheave and engages the notch therein which occurs when only the terminal portion of the stressed strip is wound thereon the sheeve 38 cannot rotate in a counter-clockwise direction. In a similar fashion a pawl 60 is pivotable about a pin 62 which is secured to housing 10 and a hair pin spring 64 biases pawl 62 into contact with a notch in the base of sheave 36 so that when the pawl 62 is engaged in the notch the sheave cannot rotate counter-clockwise. Material 44 is stressed so that if both sheaves are free to rotate the material will wind itself about sheave 36 and in so doing will drive the sheave 38 in a counterclockwise direction.

A gear 66 is keyed to shaft 41 or is otherwise secured to the shaft so as to be rotatable therewith and spacer 68, prevents the gear from moving axially. A shaft 70 is journalled between walls 10*a* and 10*b* of housing 10 and secured thereto is a gear 72 which has a smaller diameter than gear 66 and is in engagement therewith. Also rotatable with shaft 70 is a gear 80 and spacers 82 and 83 prevent gears 72 and 80 from moving axially. If desired, gears 72 and 80 may be made integral with each other. Another shaft 84 is journalled between walls 10*a* and 10*b* and a gear 86 is secured thereto. Gear 86 is smaller than gear 80 and is in mesh therewith and spacers 88 are provided on shaft 84 to prevent gear 86 from moving axially.

Figure 7:
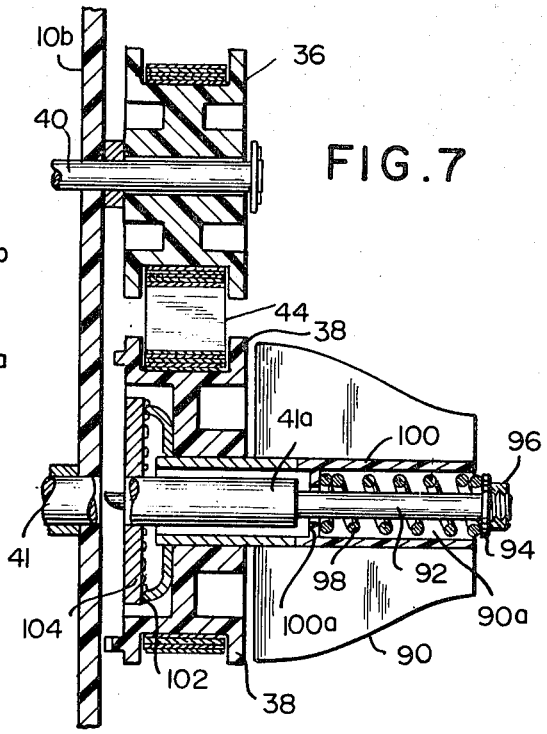
FIG. 7 is an enlarged sectional view of the spring motor and winding means therefor.
Figure 8:
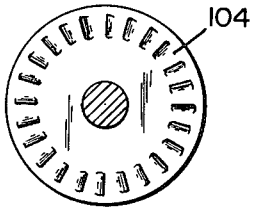
FIG. 8 is an enlarged front view of the ratchet shown in FIG. 7.

The means for energizing motor 34 can best be seen in FIG. 7 and includes a key 90. Key 90 may be made of plastic, metal or any other material and includes a hollow central portion 90*a*. Portion 41*a* of shaft 41 extends partway through the hollow central portion of key 90 and is joined to a smaller diameter shaft 92. A sleeve 100 is secured to key 90 at the hollow central portion 90*a* and includes an annular wall 100*a* with shaft 92 extending therethrough and slightly past key 90. A washer 94 surrounds the rightmost end of shaft 92 as viewed in FIG. 7 and a nut 96 is placed in engagement with the threaded end of shaft 92 to hold said washer in place. The washer is large enough to prevent a spring 98, which contacts annular wall 100*a*, from expanding through the right end of hollow central portion 90*a*.

Figure 9:
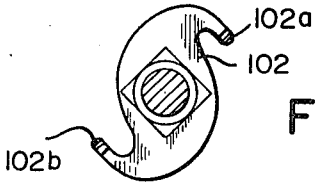
FIG. 9 is an enlarged view of the stop shown in FIG. 7.
Figure 16:
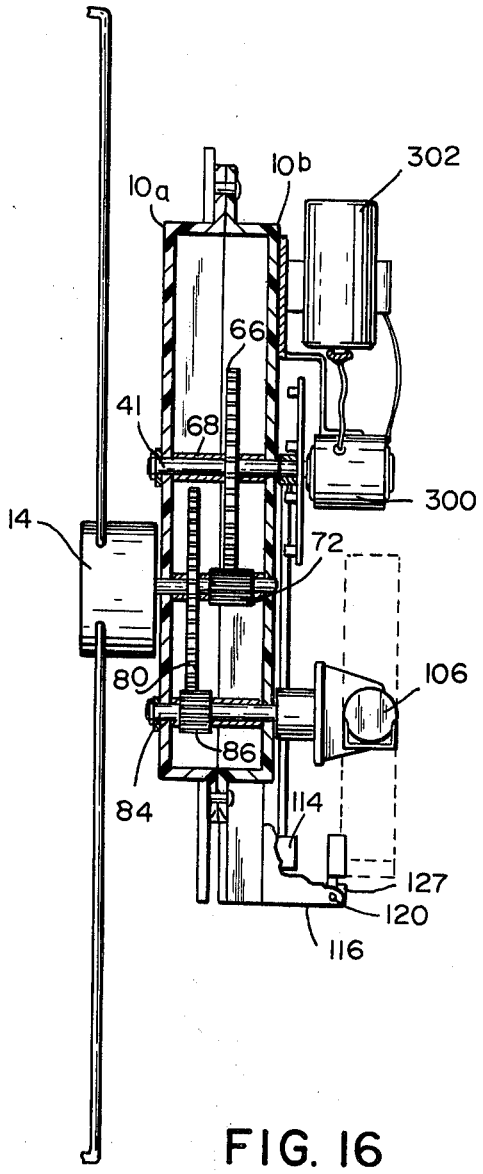
FIG. 16 is a sectional view of an alternate intermittent motion mechanism of the present invention.

Secured to sleeve 100 is sheave 38 as well as a stop 102. As can be seen in FIG. 9 stop 102 has an S configuration, is made of spring steel and has bent fingers 102*a* and 102*b* at the ends thereof. The fingers are for a purpose that will soon be readily apparent. Secured to shaft 41 is a ratchet 104 which includes a series of raised teeth for a reason that will soon be apparent. Shaft 70 extends through panel 12 and hub 14 is rotatable therewith.

Rotatable with shaft 84 is a tube 106 which may be made of any suitable non-magnetic material such as plastic. The means for securing tube 106 to shaft 84 can be conventional such as the cradle shown in the drawings. Tube 106 is closed at its opposite ends and located therein are magnets 108 and 110 which are attached to a non-magnetic spacer 112 and jointly constitute a plunger. Magnets 108 and 110 are arranged to have their south poles facing each other and their north poles facing toward the ends of tube 106. The magnets preferably are of equal strength. Magnets 108, 110 and spacer 112 are of the same cross-section which is slightly smaller than the cross-section defined by the inside surface of tube 106. Located within tube 106 is a viscous fluid such as water, mineral oil, etc. and the spacer and magnets can slide from one end of the tube to the other as will hereinafter be described.

Secured to housing wall 10*b* is a magnet 114 which has its south pole facing tube 106. Magnet 114 as well as magnets 106 and 108 and the other magnets which will hereinafter be described may be conventional ceramic magnets or other types of magnets as will be apparent to those who are skilled in the art. Extending from wall 10*b* and flanking magnet 114 are triangularly shaped supports 116 and 118 (FIGS. 5 and 6). Secured to the free end of the base of supports 116 and 118 is a pin 120. Rotatable about pin 120 is a lever 122 which includes a stop 124 at one edge thereof. A magnet 126 is positioned on lever 122 and extends therethrough and has its south pole facing the south pole of magnet 114. A pin 127 is provided on support 116 for limiting the rotation of lever 122 away from wall 10*b* to a vertical position. Lever 122 is positioned such that when the lever is in the vertical position shown in FIG. 5 the stop thereon will prevent rotation of tube 106 with said tube vertical and the magnet 126 will be positioned adjacent the bottom of said tube and in registry with magnet 114. The strength of the magnets is selected so that when the magnets within tube 106 are in the position shown in FIG. 6 the moment resulting from the repulsion between the south pole of magnet 114 and the south pole of magnet 126 and the frictional force between tube 106 and stop 124 with the tube urged to rotate by the action of the spring motor which biases the lever to a vertical position is less than the moment from the repulsion between the bottom face of the bottom magnet within tube 106 and the north pole of magnet 126 which urges the lever away from the vertical position.

The operation of the embodiment of the invention as just described is as follows. Key 90 is wound in a clockwise direction and as the key is rotated sleeve 100 rotates therewith rotating stop 102 in unison therewith. The ends of the stop slide over the raised teeth of ratchet 104. The ratchet teeth and the ends of the stop mutually shaped so that the stop may move clockwise relative to the ratchet but not counter-clockwise relative thereto. Thus it can be seen that the ratchet and stop prevent the key from being unwound unless shaft 41 rotates.

Rotation of the key results in sheave 38 rotating in a clockwise direction viewing the sheave from the back as seen in FIG. 4. This results in the stressed material 44 being unwound from sheave 36 which rotates in a counter-clockwise direction and wound about sheave 38. Continued rotation of the key 90 results in greater quantities of material 44 being wound about sheave 38. When the strip of material 44 has been almost entirely unwound from sheave 36 and placed about sheave 38 pawl 60 engages with the notch on the periphery of the base of sheave 36 (FIG. 12) to prevent further rotation of sheave 36. This insures that strip of material 44 will not be pulled loose from sheave 36 under the influence of key 90 rotating sheave 38.

The spring motor is now supplied with energy and it is assumed for purposes of illustration that tube 106 is in a vertical position with magnets 108 and 110 at the then top of the tube and lever 122 positioned so stop 124 prevents rotation of the tube with magnet 126 maintaining lever 122 in the position where the stop prevents rotation of the tube. The magnets in tube 106 slowly descend under the influence of gravity with some of the liquid therein moving from the bottom to the top of the tube until the bottommost magnet reaches the bottom of tube 106. The moment on the lever urging it away from the vertical position resulting from the repulsion between the magnet at the bottom of tube 106 and magnet 126 is greater than the moment on the lever uging it to a vertical position resulting from the repulsion between magnet 126 and 114 and the frictional force between tube 106 and stop 124. As a result, lever 122 is pivoted about its pivot point to the position seen in FIG. 6 so that stop 124 is no longer impeding rotation of tube 106. Consequently, tube 106 is free to rotate as are shafts 84, 70, 41 and 40 which results in hub 14 rotating. The rotation of hub 14 rotates arms 16, 18, 20, 22 and 24.

As hub 14 rotates each object of interest remains vertical (erect) so that locking link 26*c* rotates relative to the leg 18*b* until link 26*c* strikes leg 18*b* at which time the object stops turning relative to leg 18*b*. The object loses its erect stance when its center of gravity passes over the axis of leg 18*b* and swings to an erect position and while so doing oscillates a few times to the enjoyment of an observer. The other objects of interest operate in a similar manner.

When tube 106 rotates out of its vertical position the repulsive forces between magnets 126 and 114 bring the lever 122 to a vertical position ready to stop tube 106 at the end of its next 180° of rotation. Thus continued rotation of tube 106 to a vertical position brings the tube in contact with stop 124 with the magnets at the top of the tube and cycle can again be repeated.

If desired, the stop arrangement could be shifted from the position shown in the figures to another location for stopping the tube from rotating at a different orientation of the tube.

If desired, means can be provided for intermittently striking a chime during the operation of the mobile. The means can best be seen in FIG. 4 and includes a frame member 144 which is a generally elongated member. Frame member 144 includes a vertical slot 144*a* at its upper portion and a vertical slot 144*b* at its lower portion. Pins 140 and 142 are fixed to housing wall 10*b* and extend perpendicularly outward therefrom. Pin 140 is received in slot 144*a* whereas pin 142 is received in slot 144*b*. The upper portion of frame member 144 includes a toothed end which is positioned as shown in FIG. 4 so as to be in the path of travel of the pins 46, 48, 50 and 52 which are attached to sheave 38. Secured to the lowermost portion of frame member 144 is one end of a light helical spring 146 and a striker member 148 is secured to the other end of the spring. Striker member 148 is received within a stationary sleeve 150 and a damping means 152 is located within the sleeve and in contact with the striker member. The damping means may comprise a felt washer in contact with the striker member and guides it in its movement. A chime bar 154 is positioned beneath sleeve 152 and posts 156 and 158 extend through said chime bar. The posts are secured to housing 10. Rubber grommets 160 and 162 acoustically isolate the chime bar from the respective posts. A spring 166 secured to housing 10 biases frame member 144 in a downwards direction.

The intermittent one hundred and eighty degree rotation of tube 106 results in a substantially lesser degree of rotation of shaft 41 as a result of the gear ratios of the different gears which interconnect shafts 41, 70 and 84. A sufficient amount of rotation of sheave 38 results in one of the pins secured to the back of said sheave (FIG. 4) lifting the toothed end of frame member 144 in an upwards direction and moving to the left relative to said frame member until the then operative pin clears the toothed end and permits the frame member to descend to the position shown in FIG. 4 with pins 140 and 142 preventing further descent. Spring 166 and gravity brings frame member 144 rapidly to its downward position and the downward momentum of striker member 148 stretches spring 146. Striker member 148 strikes chime bar 154 producing a chime and returns under the bias of spring 146 to the position shown in FIG. 4. It should be noted that by having the ends of pins 46, 48, 50 and 52 cammed in one direction and by use of spring 98 the spring can be compressed as the pins slide over the hooked end of member 144 and member 206 when key 90 is rotated. For all other operating conditions the pins cannot slide over members 144 and 206 but move said members for a purpose that will soon be apparent. A description of the operation of member 206 is hereinafter set forth.

Figure 14:
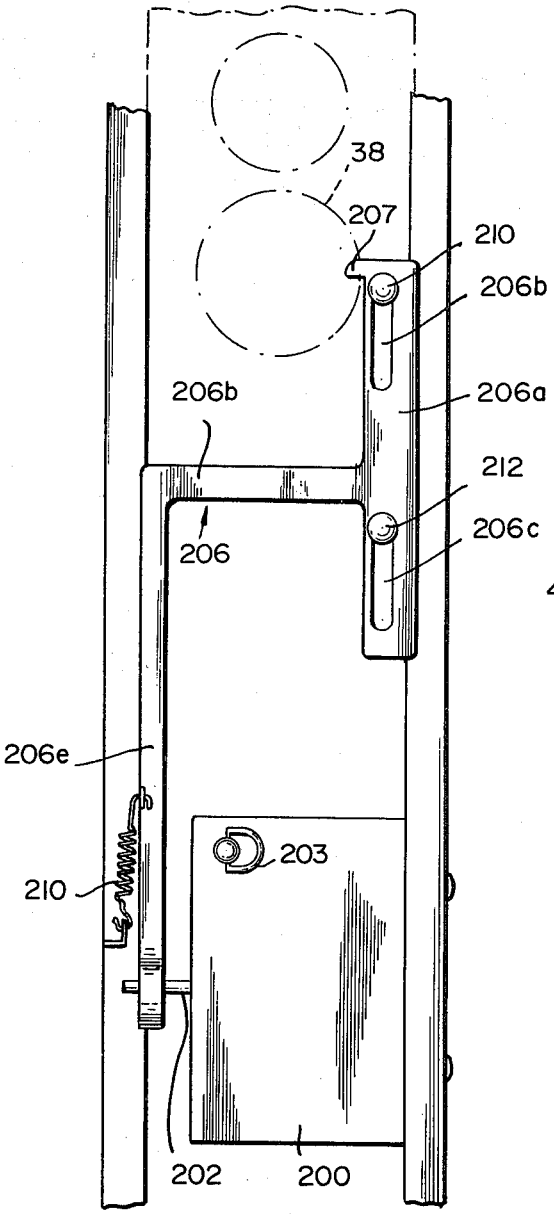
FIG. 14 is a sectional view of a modification of the present invention.

The present invention may include a music box 200 which can intermittently play. The music box 200 may be conventional and is secured to housing 10 as shown in FIG. 14. The music box includes a lever 202 which when elevated allows the music box to operate and which when in the position shown in FIG. 14 prevents operation of the music box. A key 203 is provided for winding up the music box. A frame member 206 having an upright section 206*a* with slots 206*b* and 206*c* located respectively at the upper and lower portions thereof is provided for controlling the operation of the music box. Frame member 206 includes a tooth 207 at its uppermost portion and pins 210 and 212 are secured to the housing and respectively received in the slots 206*b* and 206*c*. The tooth 207 is positioned adjacent sheave 38 in the path of the pins 46, 48, 50 and 52. A cross piece 206*d* extends perpendicularly from the approximate-midsection of portion 206*a* and an actuating arm 206*e* depends from the leftmost portion thereof with the structure as shown in FIG. 14. Lever 202 of music box 200 is received within an opening at the lowermost portion of portion 206*e* and thus moves with said portion. A spring 210 secured to housing 10 biases frame member 206 in a downwards direction.

In operation a sufficient unwinding rotation of sheave 38 results in frame member 206 being elevated by one of the pins 46, 48, 50 and 52 secured to the back of the sheave raising the toothed end of the frame member. This results in arm 206*e* elevating lever 202 with the result that music box 200 will play. Further rotation of the sheave results in the pin which elevated the toothed end of frame 206 moving to the left relative to the toothed end of the frame so the frame descends under the influence of gravity and spring 210. When this occurs the music box no longer plays since lever 202 will be in the position seen in FIG. 14 in which position the music box is idle.

In the embodiment of the invention shown in FIG. 10 a modification is made in the escapement mechanism and like parts throughout the figures are identified by the same reference numerals. In FIG. 10 a lever 240 is positioned so that one end will be beneath liquid filled tube 106 when the tube is in a vertical position. A horizontal transverse pivot 242 is provided for the lever. Located on lever 240 at the end beneath the tube is a magnet 244 having its north pole facing tube 106. Located at the same end of lever 240 adjacent the magnet is a stop 246 and a counterweight 248 is located on the other end of the lever. A magnet 250 is located directly above tube 106 when the tube is in a vertical position and has its north pole facing the tube for a reason that will soon be apparent.

In operation, if the tube is in the vertical position shown in FIG. 10 with the magnets in the middle of the tube descending toward the bottom under the influence of gravity counterweight 248 will maintain lever 240 in a position so that stop 246 will prevent rotation of tube 106. However, when the magnets within the tube descend to the bottom of the tube the moment resulting from the repulsion of the bottom magnet in the tube and magnet 244 about pivot point 242 is greater than the combined restraining moments about said pivot point as a result of the static frictional force between stop 246 and the tube and the force exerted by counterweight 248 so that the lever will pivot in a clockwise direction as seen in FIG. 10, causing the stop to clear the tube so that the tube can rotate. As soon as tube 106 has rotated a few degrees there will be no magnetic force urging lever 240 to rotate in a clockwise direction and the weight of counterweight 248 will move the lever to a horizontal position against fixed pin 249 so that stop 246 prevents further rotation of tube 106 near the end of its next 180° movement.

Magnet 250 serves to accelerate initial downward movement of the magnets within the tube from a position when the magnets are at the top of the tube since magnet 250 is arranged so as to apply a repulsive force to the then top magnet in the tube. If desired, a similarly positioned magnet can be utilized in the embodiment of the invention hereinbefore described.

When using the mobile of the invention housing 10 can be adjusted to a crib so that the objects of interest will be in a position of maximum interest for a baby lying on the bottom of the crib. It is to be noted that in normal use the mobile will be tilted so as to be inclined towards a baby in the crib and this allows the baby to have maximum exposure to the objects as they rotate.

If desired, tube 106 may be pellucid and a pellucid housing may be placed about the escapement mechanism and drive therefore with key 90 extending therethrough so that a person may rotate the key to supply energy to the spring motor. The reason for having a pellucid housing is that the movement of the escapement mechanism, to wit, tube 106, and the stop therefore, as well as the drive, provides entertainment and will maintain a young child's interest who is looking at the back of the mobile as it is operating.

While clamping means have been described in conjunction with the mobile of the present invention the mobile could be mounted on a stand with means being provided to vary the inclination of the mobile to different orientations. These different orientations can provide different perspectives to a person looking at the mobile to maintain his interest longer than if only one orientation was obtainable.

As can be seen in FIG. 14 a clamp 320 can be attached to a crib and the driven mobile of the present invention is secured to the clamp by wing nut 322. The wing nut can be loosened and the angle of inclination of the driven mobile varied with the wing nut securing the driven mobile at any desired inclination. By varying the inclination of the driven mobile the enjoyment of the infant or young child can be further increased.

It is to be noted that while an intermittently sounded music box and chime have been described in conjunction with the present invention a bell or any other similar audible means could be utilized therewith also.

While the escapement mechanism present invention has been disclosed in conjunction with a driven mobile the escapement could be used in other environments, as an example, the escapement could be used in controlling rotation of a sign, a plaque, etc. Additionally, the escapement instead of having a spring motor could be driven by a power pulley having a weight attached thereto which urges the pulley to rotate.

Figure 15:
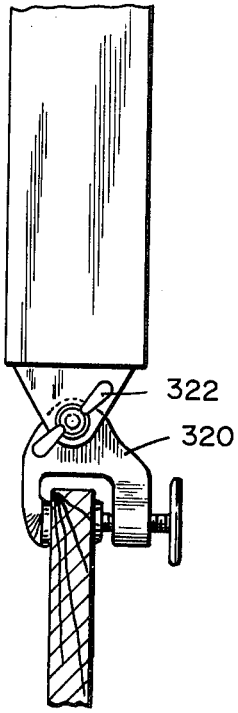
FIG. 15 is a side view of an alternate method of securing the mobile to a crib.

If desired, a battery driven motor 300 may be utilized to rotate shaft 41 with a battery 301 for motor 30 secured to the housing (FIG. 15).

As a result of the step-up gearing between shafts 41 and 70 and shafts 70 and 84 and the escapement mechanism, motor 34 will intermittently unwind in small increments which results in larger increments of rotation of shaft 70 and the objects which are rotatable therewith. Consequently, it takes a long period of time for the motor to unwind in this manner and the mobile is operative for this time overcoming one of the drawbacks of prior art mobiles. A typical running time for a toy such as illustrated is fifteen minutes with a single full windup of the motor.

While a plurality of arms are shown extending from hub 14, a disc could be rotatable therewith or without objects of interest supported by the disc.

It is thus apparent that devices are provided which achieve the objects of the invention as well as other objects not specifically herein set forth, and that are well adapted to meet the conditions of practical use.

As various possible embodiments might be made of the above invention, and as various changes may be made in the embodiments set forth, it is to be understood that all matter herein described or shown in the accompanying drawings is to be interpreted as illustrative and not in a limiting sense.

Having thus described the invention there is claimed as new and desired to be secured by Letters Patent:

1. A driven mobile comprising:
an object of interest,
means rotatable about an axis,
means mounting said object of interest on means for rotation therewith,
a motor,
means connecting said motor to said rotatable means about said axis,
means for intermittently stopping said connecting means, said means for intermittently stopping said connecting means comprising:
a. a container drivenly rotatable with said rotatable means,
b. a pair of magnets received within said container with like poles of each magnet facing the other magnet,
c. means for allowing said magnets to move together relative to said container,
d. a stop movable to a first position where it prevents rotation of said container and movable away from the first position.
e. means for moving said stop to the first position and away from the first position after the container has been stopped for more than a predetermined amount of time, said stop moving means including a third magnet fixed relative to said stop and for moving said stop, said third magnet positioned so that if either magnet in the container is adjacent said third magnet, said third magnet is repelled, thereby moving said stop from the first position,
audible signal producing means responsive to the movement of said rotatable means comprising:
a. a music box, said music box having a lever which when in a first position allows the music box to operate and which when in a second position prevents operation of the music box, and
b. an oscillating frame member spring biased to a first position, one end of said frame member intermittently engageable with said rotatable means whereby said frame member is intermittently moved to a second position against the biasing force of the spring, the opposite end of said frame member mechanically linked to the lever controlling the operation of the music box whereby the oscillating frame member actuates the lever alternately to the first and second positions.

2. A driven mobile according to claim 1 wherein said audible signal producing means responsive to the movement of said rotatable means comprises;

a. a chime bar, b. a spring biased striker member positioned adjacent said chime bar, and c. an oscillating frame member spring biased to a first position, one end of said frame member intermittently engageable with said rotatable means whereby said frame member is intermittently moved to a second position against the biasing force of the spring, the opposite end of said frame member mechanically linked to the striker member, whereby said striker member is movable with said frame member and relative thereto, said striker member impacting said chime bar when said frame member is so moved to said first position.

* * * * *